US008136493B2

(12) United States Patent
Yamaguchi et al.

(10) Patent No.: US 8,136,493 B2
(45) Date of Patent: Mar. 20, 2012

(54) LASH ADJUSTER

(75) Inventors: Katsuhisa Yamaguchi, Iwata (JP); Hiroshi Bunko, Iwata (JP); Eiji Maeno, Iwata (JP)

(73) Assignee: NTN Corporation, Osaka (JP)

( * ) Notice: Subject to any disclaimer, the term of this patent is extended or adjusted under 35 U.S.C. 154(b) by 343 days.

(21) Appl. No.: 12/595,856

(22) PCT Filed: Apr. 10, 2008

(86) PCT No.: PCT/JP2008/057092

§ 371 (c)(1),
(2), (4) Date: Oct. 14, 2009

(87) PCT Pub. No.: WO2008/129954

PCT Pub. Date: Oct. 30, 2008

(65) Prior Publication Data

US 2010/0071648 A1 Mar. 25, 2010

(30) Foreign Application Priority Data

Apr. 18, 2007 (JP) ..... 2007-109499

(51) Int. Cl.
*F01L 1/18* (2006.01)

(52) U.S. Cl. ..... 123/90.45; 123/90.46; 123/90.52; 123/90.54; 123/90.55

(58) Field of Classification Search ..... 123/90.44, 123/90.45, 90.46, 90.52, 90.54, 90.55
See application file for complete search history.

(56) References Cited

U.S. PATENT DOCUMENTS

| | | | | |
|---|---|---|---|---|
| 4,981,117 | A | 1/1991 | McRobert et al. | |
| 7,036,475 | B2 * | 5/2006 | Yasuda et al. | 123/90.52 |
| 2004/0211380 | A1 | 10/2004 | Maeno et al. | |
| 2005/0087163 | A1 | 4/2005 | Maeno et al. | |

FOREIGN PATENT DOCUMENTS

| | | |
|---|---|---|
| JP | 3-501758 | 4/1991 |
| JP | 2000-130114 | 5/2000 |
| JP | 2004-019463 | 1/2004 |
| JP | 2005-127189 | 5/2005 |
| JP | 2005-248912 | 9/2005 |

OTHER PUBLICATIONS

International Search Report issued May 27, 2008 in International (PCT) Application No. PCT/JP2008/057092.

* cited by examiner

*Primary Examiner* — Ching Chang
(74) *Attorney, Agent, or Firm* — Wenderoth, Lind & Ponack, L.L.P.

(57) ABSTRACT

A lash adjuster is provided which includes a cylindrical housing having an open top and formed with an internal thread on an inner periphery thereof, a screw rod having an external thread formed on an outer periphery thereof and in threaded engagement with the internal thread, and a spring biasing the screw rod outwardly of the housing. Each of the internal thread and the external thread having a pressure flank configured to receive pressure when a force that tends to push the screw rod into the housing acts on the screw rod, and a clearance flank having a smaller flank angle than the pressure flank. The screw rod has an end protruding from the housing and configured to support an arm of a valve operating mechanism so as to be pivotable about this end. Oil film expelling grooves are formed in the pressure flank of the external thread, using a tap having a thread that extends so as to cross the internal thread.

12 Claims, 4 Drawing Sheets

LASH ADJUSTER

BACKGROUND OF THE INVENTION

This invention relates to a lash adjuster mounted in an engine valve operating mechanism.

Many known valve operating mechanisms include an arm that pivots corresponding to the rotation of a cam, thereby pushing a valve stem connected to a valve provided at an intake or exhaust port of an engine and moving the valve.

When such a valve operating mechanism is thermally expanded due to increased ambient temperature while the engine is running, due to differences in thermal expansion coefficient between component parts of the valve operating mechanism, gaps between the respective component parts of the valve operating mechanism (including the gap between the arm and the valve stem) may change, thus producing noise and causing the valve to be opened and closed at wrong timing. Also, when the sliding portions of the valve operating mechanism become worn, gaps between the component parts of the valve operating mechanism (such as the gap between the valve and the valve seat) may change, thus producing noise.

In order to eliminate such changes in gaps between the component parts of the valve operating mechanism, the pivot point of the arm is, in many cases, supported by a lash adjuster to automatically adjust the pivot point of the arm with the lash adjuster.

One known lash adjuster of this type includes a cylindrical housing with an open top, a screw rod having an external thread formed on its outer periphery and in threaded engagement with an internal thread formed on the inner periphery of the housing, and a spring biasing the screw rod outwardly of the housing, with the protruding end of the screw rod supporting the pivot point of the arm.

The external thread formed on the outer periphery of the screw rod and the internal thread formed on the inner periphery of the housing both comprises a pressure flank that receives pressure when a force that tends to push the screw rod into the housing (hereinafter referred to as "pushing force") is applied, and a clearance flank having a smaller flank angle than the pressure flank.

With this lash adjuster, when pushing force is applied to the screw rod due to the rotation of the cam, the pressure flank of the external thread formed on the outer periphery of the screw rod is supported by the pressure flank of the internal thread formed on the inner periphery of the housing, so that the screw rod is not axially movable. When the relative position between the arm and the valve stem changes due e.g. to thermal expansion of the valve operating mechanism, the screw rod moves axially in the housing while rotating, thereby eliminating the changes in gaps between component parts of the valve operating mechanism.

In this arrangement, the moment the pressure flank of the external thread formed on the outer periphery of the screw rod is supported on the pressure flank of the internal thread formed on the inner periphery of the housing, any engine oil that exists between the pressure flanks may form an oil film due to the squeezing effect. Especially while the ambient temperature is low, an oil film tends to form between the pressure flanks because the viscosity of engine oil is high at low temperature.

If an oil film forms between the pressure flanks, the oil film dramatically reduces the friction between the pressure flanks. Thus, when pushing force is applied to the screw rod due to the rotation of the cam, the screw rod may rotate and be pushed into the housing. If the screw rod is pushed into the housing, the pivot point of the arm moves, thus causing the valve to be impulsively seated on the valve seat and producing noise.

In order to expel such oil film between the pressure flanks, a lash adjuster is proposed in which oil film expelling grooves are formed in the pressure flank of the external thread formed on the outer periphery of the screw rod so as to extend parallel to the external thread (JP3-501758A). For the same purpose, in another lash adjuster, axial grooves are formed by broaching in the internal thread formed on the inner periphery of the housing to divide the internal thread into a plurality of separate portions (JP2000-130114A). In these lash adjusters, engine oil present between the pressure flanks is expelled into the oil film expelling grooves, thereby preventing formation oil film between the pressure flanks.

In the case of the former lash adjuster, because the oil film expelling grooves are formed parallel to the thread, the oil film expelling grooves are long, so that engine oil in the oil film expelling grooves is difficult to flow. This in turn makes it difficult for engine oil present between the pressure flanks to flow into the oil film expelling grooves, and thus making it difficult to effectively prevent formation of oil film between the pressure flanks.

For the latter lash adjuster, because the internal thread is formed by a tap and the oil film expelling grooves are formed by broaching, a larger number of manufacturing steps are needed, and thus the manufacturing cost is high. Also, if the internal thread is axially long, it is difficult to form oil film expelling grooves by broaching.

An object of the present invention is to provide a lash adjuster which can effectively eliminate oil film between the pressure flanks and which can be manufactured at a low cost.

SUMMARY OF THE INVENTION

In order to achieve this object, oil film expelling grooves are formed in the pressure flank of the internal thread, using a tap having a thread that extends in a direction crossing the internal thread.

The thread of the tap may have a lead angle that differs from the lead angle of the internal thread, whereby the thread of the tap crosses the internal thread. Alternatively, a tap may be used of which helix direction is opposite to the helix direction of the internal thread, whereby the thread of the tap crosses the internal thread.

Preferably, the lash adjuster according to this invention has the following structural features.

1) The tap has an outer diameter larger than an effective diameter of the internal thread, and a root diameter smaller than the effective diameter of the internal thread.

2) The thread of the tap has a pitch smaller than the pitch of the internal thread.

With the lash adjuster according to this invention, because the oil film expelling grooves are formed in the internal thread, using a tap having a thread that crosses the internal thread, each oil expelling groove has one end thereof open to the apex of the internal thread. Thus, engine oil in the oil film expelling grooves can more easily flow. This in turn makes it easier for engine oil present between the pressure flanks to flow into the oil film expelling grooves, and thus makes it possible to effectively eliminate oil film between the pressure flanks. Also, because the internal thread and the oil film expelling grooves can both be formed by a tap, it is possible to reduce the number of manufacturing steps and thus the manufacturing cost.

In the arrangement in which the helix direction of the internal thread 21 is opposite to the helix direction of the oil film expelling grooves 24 so that the thread of the tap crosses the internal thread, because the internal thread crosses the oil film expelling grooves at a large angle, it is possible to minimize the formation of burrs at portions where the respective oil film expelling grooves intersect the apex of the internal thread.

In the arrangement in which the tap has an outer diameter larger than the effective diameter of the internal thread, and a root diameter smaller than the effective diameter of the internal thread, it is possible to reliably form the oil film expelling grooves while keeping the apex of the internal thread intact.

In the arrangement in which the thread of the tap has a pitch smaller than the pitch of the internal thread, because the distance between the adjacent oil film expelling grooves is small, it is possible to effectively expel oil film between the pressure flanks.

DETAILED DESCRIPTION OF THE PREFERRED EMBODIMENTS

Figure 1:
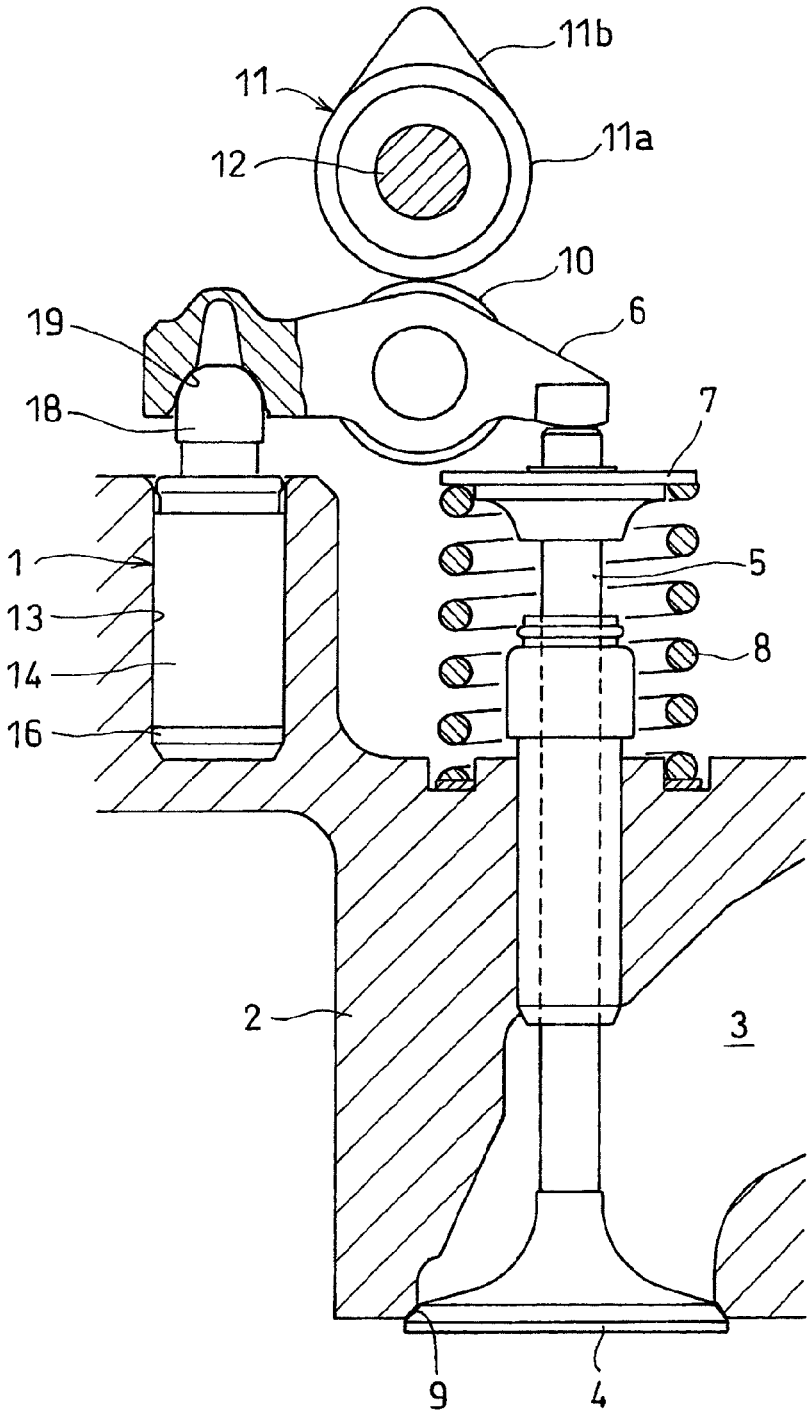
FIG. 1 is a front view of a valve operating mechanism including a lash adjuster embodying the present invention.

FIG. 1 shows a valve operating mechanism including a lash adjuster 1 embodying the present invention. This valve operating mechanism includes a valve 4 provided at an intake port 3 of an engine cylinder head 2, a valve stem 5 connected to the valve 4, and an arm 6 pivotally supported by the lash adjuster 1.

The valve stem 5 extends upwardly from the valve 4 and is slidably inserted through the cylinder head 2. An annular spring retainer 7 is fixed to the outer periphery of the valve stem 5 at its top end. A valve spring 8 is mounted between the bottom surface of the spring retainer 7 and the top surface of the cylinder head 2. The valve spring 8 biases the valve stem 5 upwardly through the spring retainer 7, thereby seating the valve 4 on a valve seat 9.

The arm 6 has one end thereof supported by the lash adjuster 1, and the other end in contact with the top end of the valve stem 5. A roller 10 is mounted to the central portion of the arm 6. The roller 10 is in contact with a cam 11 provided over the arm 6. The cam 11 is fixedly mounted around a camshaft 12. When the camshaft 12 rotates, the cam lobe 11*b* which protrudes from the base circle 11*a* presses down the arm 6 through the roller 10.

Figure 2:
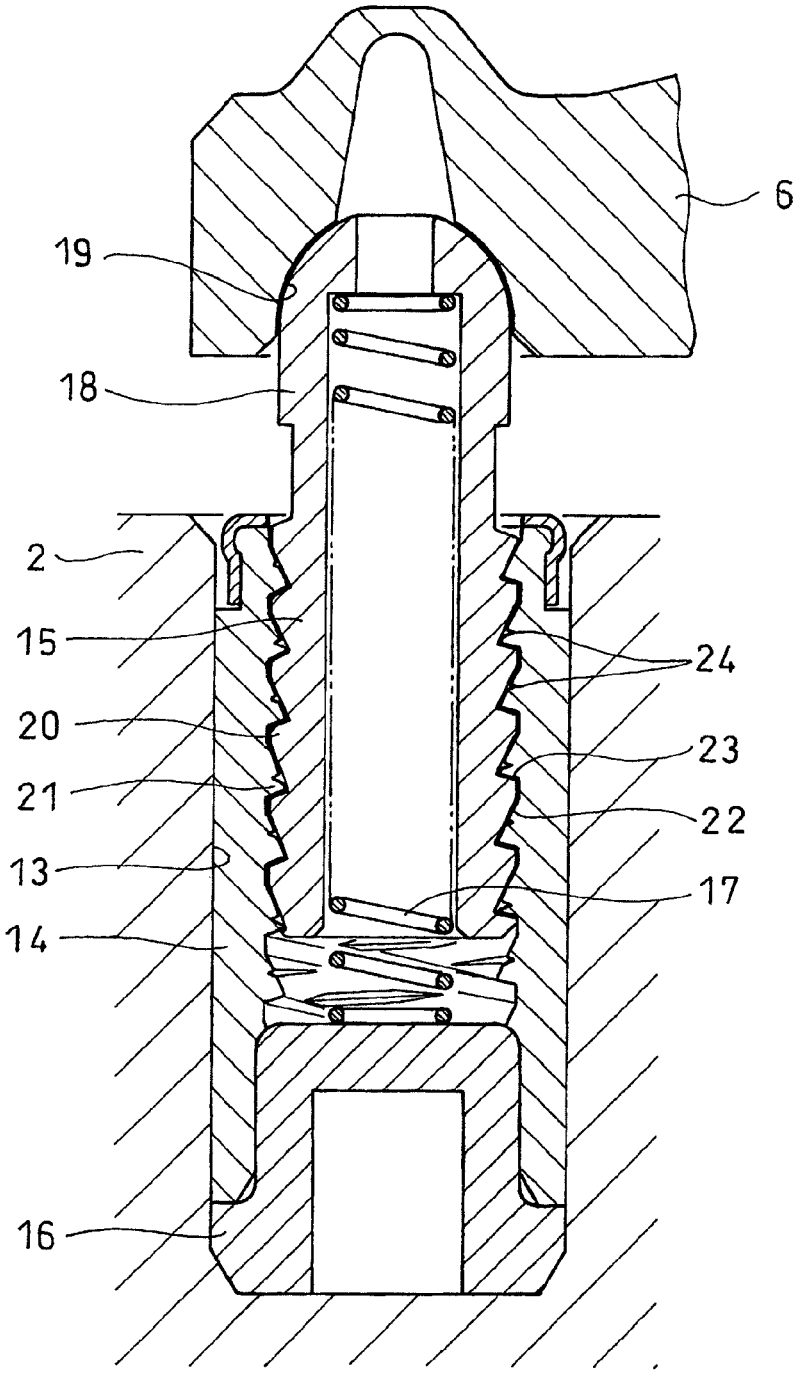
FIG. 2 is a sectional front view of the lash adjuster shown in FIG. 1.

The lash adjuster 1 is received in a hole 13 formed in the top surface of the cylinder head 2. As shown in FIG. 2, the lash adjuster 1 comprises a cylindrical housing 14 having an open top, a screw rod 15 inserted in the housing 14, a bottom member 16 closing the bottom end of the housing 14, and a spring 17.

The spring 17 is mounted between the bottom member 16 and the screw rod 15 and biases the screw rod 15 outwardly of the housing 14. The screw rod 15 has a hemispherical end 18 protruding from the housing 14. The protruding end 18 is received in a recess 19 formed in the bottom surface of the arm 6, and supports the arm 6 so as to be pivotable about the recess 19.

The screw rod 15 has an external thread 20 formed on the outer periphery thereof at its lower portion and in threaded engagement with an internal thread 21 formed on the inner periphery of the housing 14. The external thread 20 and the internal thread 21 both have an asymmetrical serration-shaped axial section, and comprises a pressure flank 22 for receiving pressure when force acts on the screw rod 15 that tends to push the screw rod 15 into the housing 14, and a clearance flank 23 having a smaller flank angle than the pressure flank 22.

Figure 3:
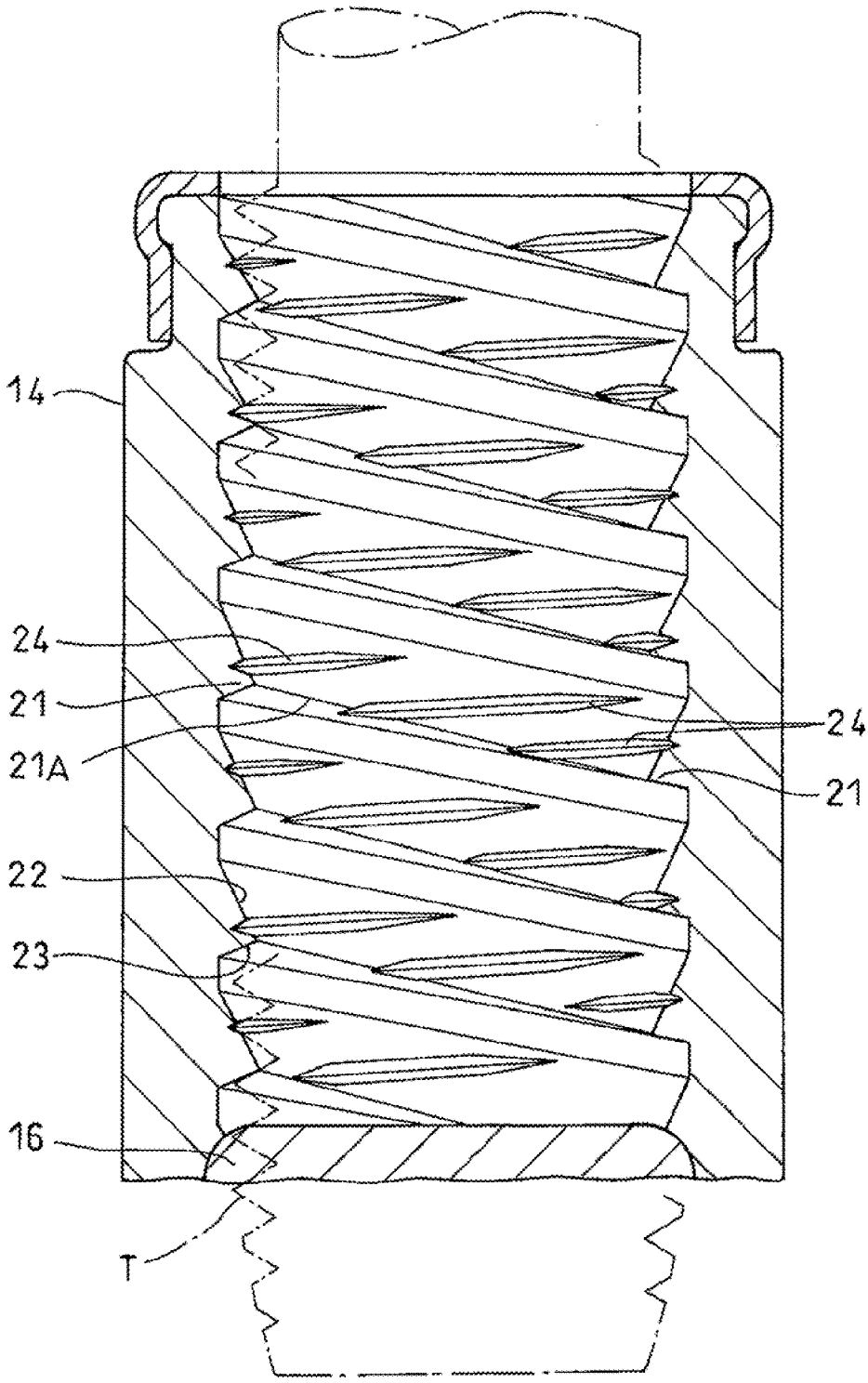
FIG. 3 is an enlarged sectional view of the housing of FIG. 2 with the screw rod removed.

As shown in FIG. 3, oil film expelling grooves 24 are formed in the pressure flank 22 of the internal thread 21 with a tap T having a helix direction (counterclockwise in the figures) opposite to the helix direction of the internal thread 21 (clockwise in the figures). Thus, as shown in FIG. 3, the grooves 24 extend in a direction that crosses the direction in which the internal thread 21 extends. As also shown in FIG. 3, the grooves 24 are spaced from each other in the direction in which the internal thread 21 extends. Also, each oil film expelling groove 24 extends to the apex 21A of the internal thread 21.

Figure 4:
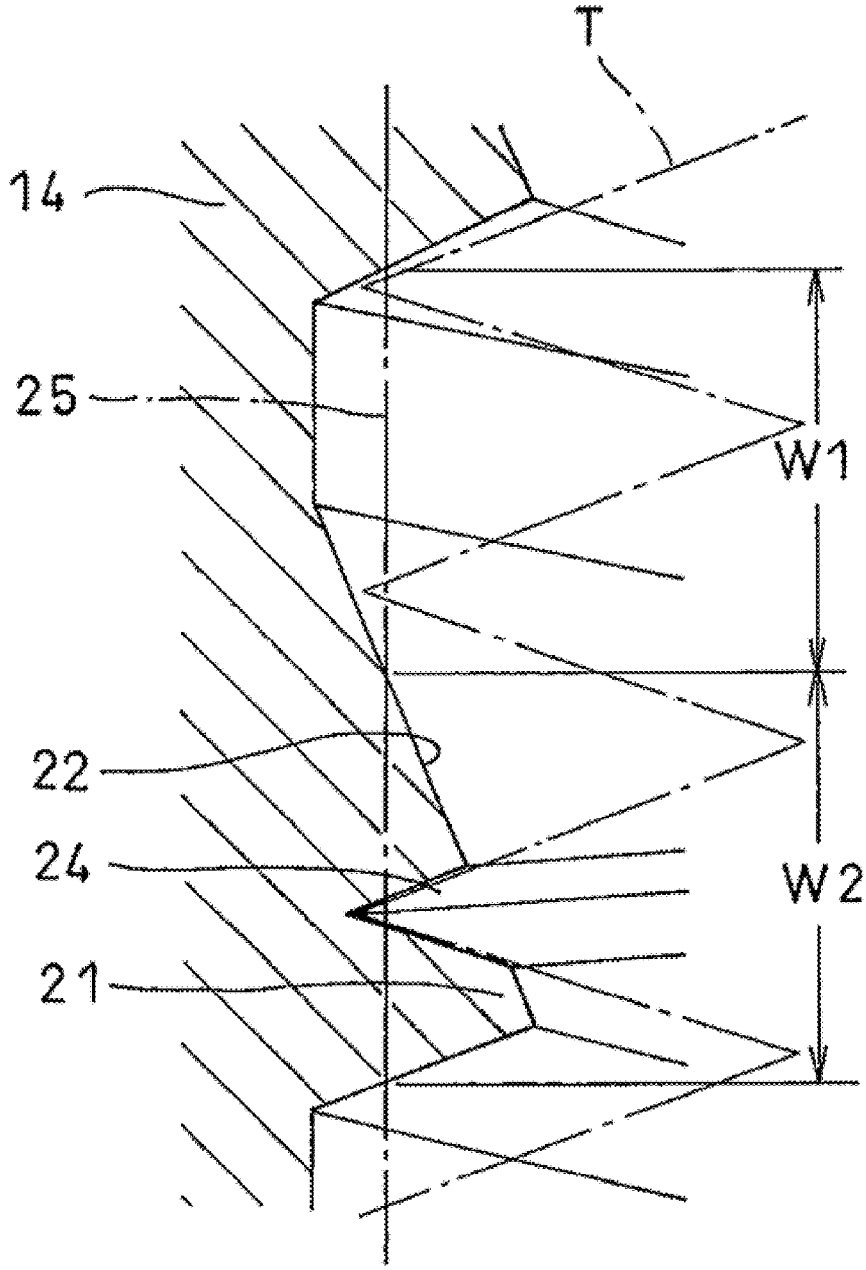
FIG. 4 is an enlarged sectional view of an internal thread formed on the inner periphery of the housing shown in FIG. 3.

The oil film expelling grooves 24 are formed with a tap T having an outer diameter larger than the effective diameter of the internal thread 21 (diameter of an imaginary cylinder 25 where the width W1 of the thread groove is equal to the width W2 of the thread ridge), and a root diameter smaller than the effective diameter of the internal thread 21. Thus, as shown in FIG. 4, the oil film expelling grooves 24 reliably extend to portions of the pressure flank where the diameter is larger than the diameter of the imaginary cylinder 25, while keeping the apex of the internal thread intact. The pitch of the tap T (i.e. the axial distance between adjacent oil film expelling grooves 24) is smaller than the pitch of the internal thread 21.

In this valve operating mechanism, when the camshaft 12 rotates and the cam lobe 11*b* of the cam 11 presses down the arm 6, the valve 4 separates from the valve seat 9, thereby opening the intake port 3. In this state, although pushing force is applied to the screw rod 15, because the pressure flank 22 of the external thread 20 is supported by the pressure flank 22 of the internal thread 21, the screw rod 15 never moves axially.

When the camshaft 12 further rotates and the cam lobe 11*b* moves past the roller 10, the valve stem 5 moves upward under the biasing force of the valve spring 8, thus seating the valve 4 on the valve seat 9, closing the intake port 3.

While the engine is running, if there exists a difference in thermal expansion between component parts of the valve operating mechanism such as the cylinder head 2, valve stem 5 and arm 6, and the distance between the cam 11 and the arm 6 increases, the screw rod 15 protrudes while rotating under the biasing force of the spring 17, thus eliminating a gap between the base circle 11*a* of the cam 11 and the roller 10, which in turn prevents impulsive seating of the valve 4 on the valve seat 9. If the contact surfaces of the valve 4 and the valve seat 9 become worn, the screw rod 15 is pushed into the housing while rotating under the biasing force of the valve spring 8, so that the valve stem 5 moves upward until the gap between the contact surfaces of the valve 4 and the valve seat 9 disappears.

In this lash adjuster 1, the moment the pressure flank 22 of the external thread 20 of the screw rod 15 is supported on the pressure flank 22 of the internal thread 21 of the housing 14, any engine oil that exists between the pressure flanks 22 is released into the oil film expelling grooves 24. This minimizes the formation of oil film due to the squeezing effect between the pressure flanks 22, and thus ensures that axial force applied to the screw rod can be quickly supported by the internal thread 21 of the housing 14. This in turn makes it possible to reliably prevent the screw rod 15 from being pushed into the housing even when the ambient temperature is low and the viscosity of engine oil is high.

Further, in this lash adjuster 1, since each oil film expelling groove 24 has one end thereof extending to the apex 21A of the internal thread 21, engine oil in the oil film expelling grooves 24 can more easily flow. Thus, the moment the pressure flank 22 of the external thread 20 of the screw rod 15 is supported on the pressure flank 22 of the internal thread 21 of the housing 14, engine oil that exists between the pressure flanks 22 can easily flow into the oil film expelling grooves 24. Thus, it is possible to more easily expel oil film between the pressure flanks 22.

In this lash adjuster 1, because the internal thread 21 and the oil film expelling grooves 24 are both formed by taps, the internal thread 21 and the oil film expelling grooves 24 can be formed in the housing 14 by chucking the housing once. This reduces the number of machining steps and thus the manufacturing cost. Also, since the oil film expelling grooves 24 are formed by a tap T, it is possible to easily form the oil film expelling grooves 24 even if the internal thread 21 is axially long.

Further, with this lash adjuster 1, since the oil film expelling grooves 24 are formed using a tap T having a thread of which the helix direction is opposite to the helix direction of the internal thread 21, the internal thread 21 crosses the oil film expelling grooves 24 at a large angle, which minimize the formation of burrs at portions where the respective oil film expelling grooves 24 intersect the apex 21A of the internal thread.

Also, because the pitch of the tap T (i.e. the axial distance between adjacent oil film expelling grooves 24) is smaller than the pitch of the internal thread 21, the distance between the adjacent oil film expelling grooves 24 is small, so that oil film can be effectively expelled.

In the embodiment, a tap is used of which the helix direction of the thread is opposite to the helix direction of the internal thread so that the thread of the tap crosses the internal thread 21. But instead, a tap may be used having a thread of which the helix direction is the same as the helix direction of the internal thread but of which the lead angle differs from that of the internal thread 21 so that the thread of the tap crosses the internal thread 21.

What is claimed is:

1. A lash adjuster comprising a cylindrical housing having an open top and formed with an internal thread on an inner periphery thereof, a screw rod having an external thread formed on an outer periphery thereof and in threaded engagement with said internal thread, and a spring biasing said screw rod outwardly of said housing, each of said internal thread and said external thread comprising a pressure flank configured to receive pressure when a force that tends to push the screw rod into the housing acts on the screw rod, and a clearance flank having a smaller flank angle than said pressure flank, said screw rod having an end protruding from said housing and configured to support an arm of a valve operating mechanism so as to be pivotable about said end, wherein the pressure flank of said internal thread has oil film expelling grooves formed therein to extend in a direction to cross the direction in which said internal thread extends, said oil film expelling grooves being formed using a tap having a thread that extends so as to cross the internal thread.

2. The lash adjuster of claim 1 wherein said oil film expelling grooves have a lead angle that differs from a lead angle of said internal thread.

3. The lash adjuster of claim 2 wherein said oil film expelling grooves have a bottom diameter larger than an effective diameter of said internal thread, and wherein said internal thread has an apex that extends continuously in the direction in which said internal thread extends.

4. The lash adjuster of claim 3 wherein said oil film expelling grooves have a pitch smaller than a pitch of said internal thread.

5. The lash adjuster of claim 2 wherein said oil film expelling grooves have a pitch smaller than a pitch of said internal thread.

6. The lash adjuster of claim 1 wherein a helix direction of said oil film expelling grooves is opposite to a helix direction of said internal thread.

7. The lash adjuster of claim 6 wherein said oil film expelling grooves have a bottom diameter larger than an effective diameter of said internal thread, and wherein said internal thread has an apex that extends continuously in the direction in which said internal thread extends.

8. The lash adjuster of claim 7 wherein said oil film expelling grooves have a pitch smaller than a pitch of said internal thread.

9. The lash adjuster of claim 6 wherein said oil film expelling grooves have a pitch smaller than a pitch of said internal thread.

10. The lash adjuster of claim 1 wherein said oil film expelling grooves have a bottom diameter larger than an effective diameter of said internal thread, and wherein said internal thread has an apex that extends continuously in the direction in which said internal thread extends.

11. The lash adjuster of claim 10 wherein said oil film expelling grooves have a pitch smaller than a pitch of said internal thread.

12. The lash adjuster of claim 1 wherein said oil film expelling grooves have a pitch smaller than a pitch of said internal thread.

* * * * *